US007803066B2

(12) United States Patent
Solheim et al.

(10) Patent No.: US 7,803,066 B2
(45) Date of Patent: Sep. 28, 2010

(54) GOLF CLUB HEAD WITH THREE-DIMENSIONAL ALIGNMENT AID AND METHOD OF MANUFACTURE

(75) Inventors: John A. Solheim, Phoenix, AZ (US); Richard R. Sanchez, Phoenix, AZ (US); John C. Souza, Phoenix, AZ (US)

(73) Assignee: Karsten Manufacturing Corporation, Phoenix, AZ (US)

( * ) Notice: Subject to any disclaimer, the term of this patent is extended or adjusted under 35 U.S.C. 154(b) by 87 days.

(21) Appl. No.: 12/164,956

(22) Filed: Jun. 30, 2008

(65) Prior Publication Data

US 2009/0270198 A1 Oct. 29, 2009

Related U.S. Application Data

(60) Provisional application No. 61/048,679, filed on Apr. 29, 2008.

(51) Int. Cl.
*A63B 53/04* (2006.01)

(52) U.S. Cl. ..... 473/340; 473/341

(58) Field of Classification Search ..... 473/251–253, 473/324–350

See application file for complete search history.

(56) References Cited

U.S. PATENT DOCUMENTS 3,841,640 A * 10/1974 Gaulocher ..... 473/249
3,888,492 A * 6/1975 Cabot ..... 473/255
D235,668 S * 7/1975 Swash ..... D21/739
4,121,833 A * 10/1978 Prueter ..... 473/330
D316,129 S 4/1991 Bryson
5,080,365 A * 1/1992 Winchell ..... 473/255
5,116,047 A * 5/1992 Phelan et al. ..... 473/307
D334,039 S * 3/1993 Tanaka ..... D21/739
5,351,961 A * 10/1994 Eulau ..... 473/252
5,476,262 A * 12/1995 Bandiero ..... 473/409
5,685,784 A * 11/1997 Butler ..... 473/340
5,820,481 A * 10/1998 Raudman ..... 473/313
5,830,078 A * 11/1998 McMahan ..... 473/252
5,888,148 A * 3/1999 Allen ..... 473/290
5,993,324 A * 11/1999 Gammil ..... 473/251

(Continued)

FOREIGN PATENT DOCUMENTS

JP 10080507 A * 3/1998

(Continued)

OTHER PUBLICATIONS

Stina Sternberg and Ashley Mayo, "2008 Spring Equipment Preview," Golf for Women, May-Jun. 2008 at 114.

(Continued)

*Primary Examiner*—Alvin A Hunter

(57) ABSTRACT

A golf club head has a front wall member and a rear wall member joined by a pair of arms that extend rearward from the from the heel and toe ends of the front wall member. An arcuate wall formed in the rear wall member provides an alignment aid. The club may have a protrusion extending above the top rail. The protrusion may have an arcuate surface that corresponds to the arcuate wall formed in the rear member to enhance alignment of the golf club head. The club head may include a transverse alignment aid to assist the user with proper eye position and lie of the club head when addressing the golf ball.

25 Claims, 10 Drawing Sheets

U.S. PATENT DOCUMENTS 6,080,070 A * 6/2000 Whitley ..... 473/340
6,267,689 B1 * 7/2001 Ambrose ..... 473/251
6,319,146 B1 * 11/2001 Mills ..... 473/244
6,350,208 B1 * 2/2002 Ford ..... 473/249
6,379,259 B1 * 4/2002 Opie ..... 473/251
6,471,600 B2 * 10/2002 Tang et al. ..... 473/242
6,558,268 B2 * 5/2003 Tindale ..... 473/244
6,648,771 B1 * 11/2003 Mills ..... 473/244
6,663,497 B2 * 12/2003 Cameron ..... 473/245
6,752,723 B2 * 6/2004 Cullen ..... 473/251
6,793,588 B2 * 9/2004 Tang et al. ..... 473/242
6,796,911 B2 * 9/2004 Grace ..... 473/251
6,837,801 B1 * 1/2005 Souza et al. ..... 473/251
6,893,355 B2 * 5/2005 Souza et al. ..... 473/251
6,896,625 B2 * 5/2005 Grace ..... 473/251
6,905,420 B2 * 6/2005 Tang et al. ..... 473/242
6,926,615 B1 * 8/2005 Souza et al. ..... 473/251
6,929,559 B1 * 8/2005 Grace ..... 473/251
6,929,564 B2 * 8/2005 Olsavsky et al. ..... 473/340
6,960,140 B2 * 11/2005 Solheim et al. ..... 473/251
6,966,845 B2 * 11/2005 Solheim et al. ..... 473/251
6,988,956 B2 * 1/2006 Cover et al. ..... 473/244
6,988,959 B2 * 1/2006 Pollman ..... 473/313
7,004,849 B2 * 2/2006 Cameron ..... 473/249
7,014,566 B1 * 3/2006 Norvise ..... 473/231
7,048,639 B2 * 5/2006 Grace ..... 473/251
7,048,646 B2 * 5/2006 Yamanaka et al. ..... 473/332
7,052,409 B2 * 5/2006 Goldsmith ..... 473/242
7,052,410 B2 * 5/2006 Cameron ..... 473/245
7,052,411 B2 5/2006 Solheim et al.
7,077,758 B2 * 7/2006 Rohrer ..... 473/251
7,083,526 B2 * 8/2006 Durnin ..... 473/251
D527,777 S 9/2006 Solheim et al.
D529,108 S 9/2006 Stites et al.
7,147,569 B2 * 12/2006 Tang et al. ..... 473/249
7,156,759 B2 * 1/2007 Pollman ..... 473/409
7,166,036 B2 * 1/2007 Byrne et al. ..... 473/242
7,166,039 B2 * 1/2007 Hettinger et al. ..... 473/331
7,169,061 B2 * 1/2007 Hou ..... 473/341
7,175,537 B2 * 2/2007 Pollman ..... 473/203
7,223,178 B2 * 5/2007 Henry ..... 473/252
7,235,021 B2 * 6/2007 Solheim et al. ..... 473/251
D548,295 S * 8/2007 Jertson et al. ..... D21/736
7,255,650 B2 * 8/2007 Braynt et al. ..... 473/252
7,344,451 B2 * 3/2008 Tang et al. ..... 473/340
7,347,793 B2 * 3/2008 Davis ..... 473/305
7,351,162 B2 * 4/2008 Soracco et al. ..... 473/335
7,371,185 B1 * 5/2008 Rohrer ..... 473/255
7,371,187 B2 * 5/2008 Moriyama et al. ..... 473/324
7,374,497 B2 * 5/2008 Brown ..... 473/251
7,377,858 B2 * 5/2008 Kubota ..... 473/251
7,396,289 B2 * 7/2008 Soracco et al. ..... 473/251
7,396,295 B1 * 7/2008 Frame et al. ..... 473/337
7,399,233 B2 * 7/2008 Pollman ..... 473/251
7,407,443 B2 * 8/2008 Franklin et al. ..... 473/251
7,438,648 B2 * 10/2008 Wahl et al. ..... 473/340
7,455,599 B2 * 11/2008 Jones ..... 473/340
7,473,188 B2 * 1/2009 Nishino ..... 473/340
7,491,131 B2 * 2/2009 Vinton ..... 473/251
D591,806 S * 5/2009 Cameron ..... D21/743
D600,762 S * 9/2009 Serrano et al. ..... D21/743
7,588,499 B2 * 9/2009 Tateno ..... 473/251
7,601,076 B2 * 10/2009 Rollinson ..... 473/288
2006/0094533 A1 5/2006 Warren et al.
2006/0166755 A1 7/2006 Brown
2007/0191135 A1 8/2007 Nilsson et al.

FOREIGN PATENT DOCUMENTS

JP 10192461 A * 7/1998
JP 10234901 A * 9/1998
JP 2000271253 A * 10/2000
JP 2003339924 A * 12/2003
JP 2005046442 A * 2/2005
JP 2005065796 A * 3/2005
JP 2005199073 A * 7/2005
JP 2005211613 A * 8/2005
JP 2006020932 A * 1/2006
JP 2006246950 A * 9/2006
JP 2006255358 A * 9/2006
JP 2006326216 A * 12/2006
JP 2007029648 A * 2/2007
JP 2007029690 A * 2/2007
JP 2007054227 A * 3/2007
JP 2007130203 A * 5/2007
JP 2007307353 A * 11/2007
JP 2007313304 A * 12/2007
JP 2008132197 A * 6/2008
WO WO 03068335 A1 * 8/2003
WO WO 2004108226 A1 * 12/2004
WO WO 2005023379 A1 * 3/2005
WO WO 2005035073 A1 * 4/2005
WO WO 2005102467 A1 * 11/2005
WO WO 2006136048 A1 * 12/2006
WO WO 2007035105 A1 * 3/2007
WO WO 2007094679 A1 * 8/2007

OTHER PUBLICATIONS

Stina Sternberg, "Hot List 2008—Putters," Golf Digest, Feb. 2008 at 158-169, also available at: http://www.golfdigest.com/equipment/ratings.

* cited by examiner

GOLF CLUB HEAD WITH THREE-DIMENSIONAL ALIGNMENT AID AND METHOD OF MANUFACTURE

CROSS-REFERENCE TO RELATED APPLICATION

This is a nonprovisional application claiming the benefit of provisional application no. 61/048,679 filed Apr. 29, 2008.

FIELD OF THE INVENTION

The present invention relates generally to golf equipment and in particular to golf putters.

DRAWINGS

DESCRIPTION

Figure 1:
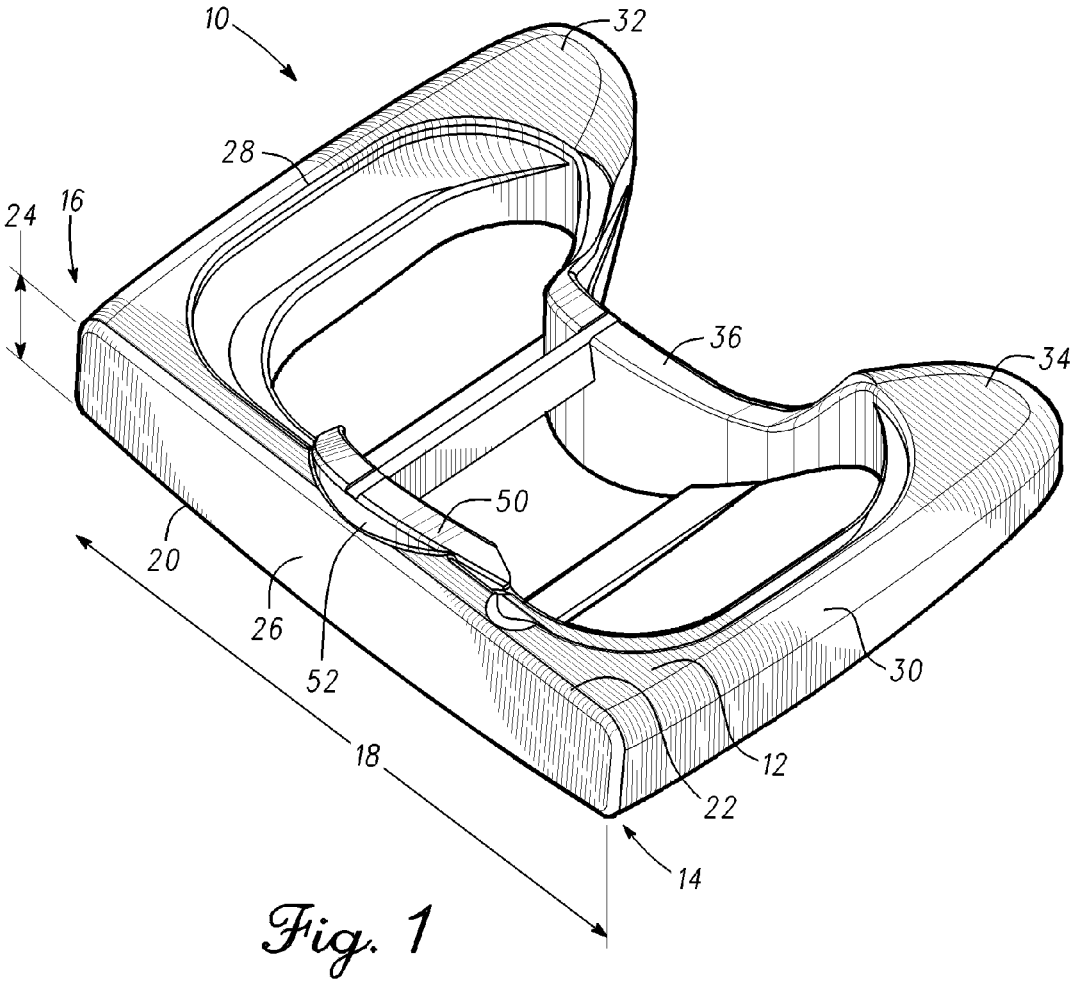
FIG. 1 is a front perspective view of an illustrative embodiment of a putter head incorporating features of the present invention.

With reference to FIGS. 1-6 and in particular to FIGS. 1-5, a golf club head 10 comprises a front wall member 12 having a heel end 14, a toe end 16 and a horizontal width dimension 18. Golf club head 10 further comprises a sole 20, a top rail 22 and a vertical height dimension 24. Front wall member 12 further includes a generally planar front face 26 adapted for impacting a golf ball. Golf club head 10 may be formed of conventional materials such as stainless steel or aluminum and/or may incorporate exotic materials such as aramid or graphite composites or liquid metals all without departing from the scope of the invention Golf club head 10 further includes a first arm 28 that extends generally rearward from toe end 16 of front wall member 12 and a second arm 30 extending generally rearward from heel end 14 of front wall member 12. First arm 28 may be generally parallel to second arm 30 with first arm 28 and second arm 30 substantially normal to front wall member 12. As used herein, forward, rearward, above, below and other indications of direction are with reference to the club in its normal position prior to impacting a golf ball with the forward direction being the direction toward the golf ball. First arm 28 has a rearward portion 32 that is joined to rearward portion 34 of second arm 30 by a rear wall member 36. Front wall member 12, first arm 28, second arm 30 and rear wall member 36 cooperate to form an open space that extends through golf club head 10. Rearward portion 32 of first arm 28 and rearward portion 34 of second arm 30 protrude rearward of rear wall member 36 to increase the perimeter weighting and polar moment of inertia of golf club head 10.

Figure 2:
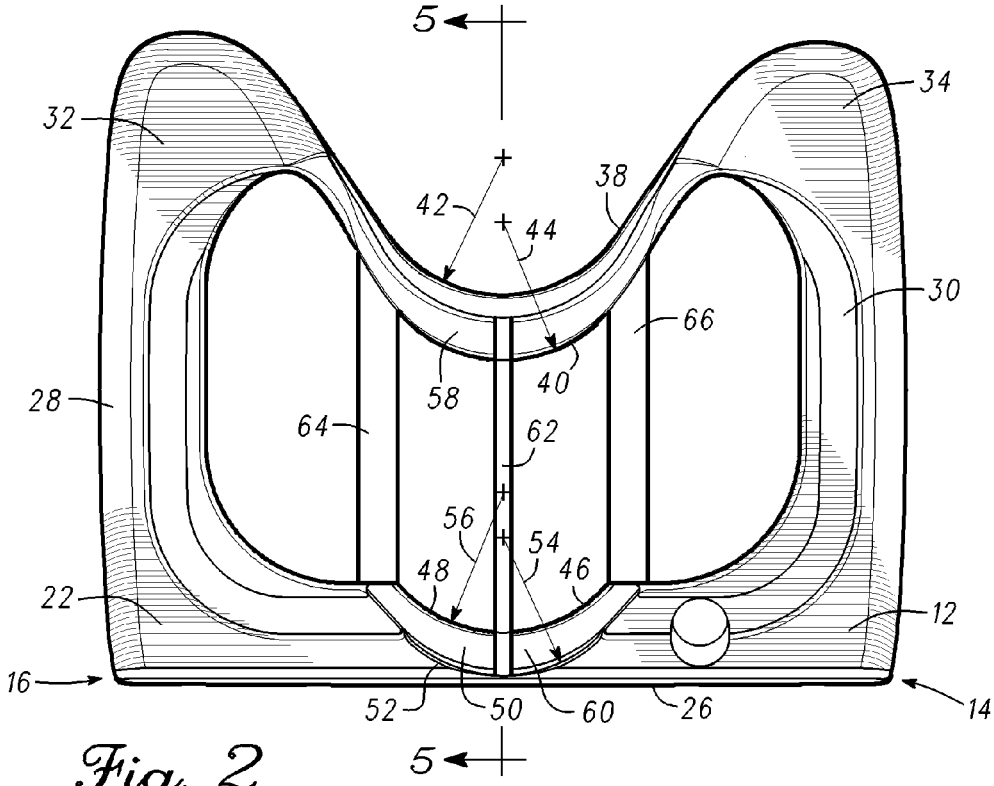
FIG. 2 is a top view of the putter head of FIG. 1.
Figure 3:
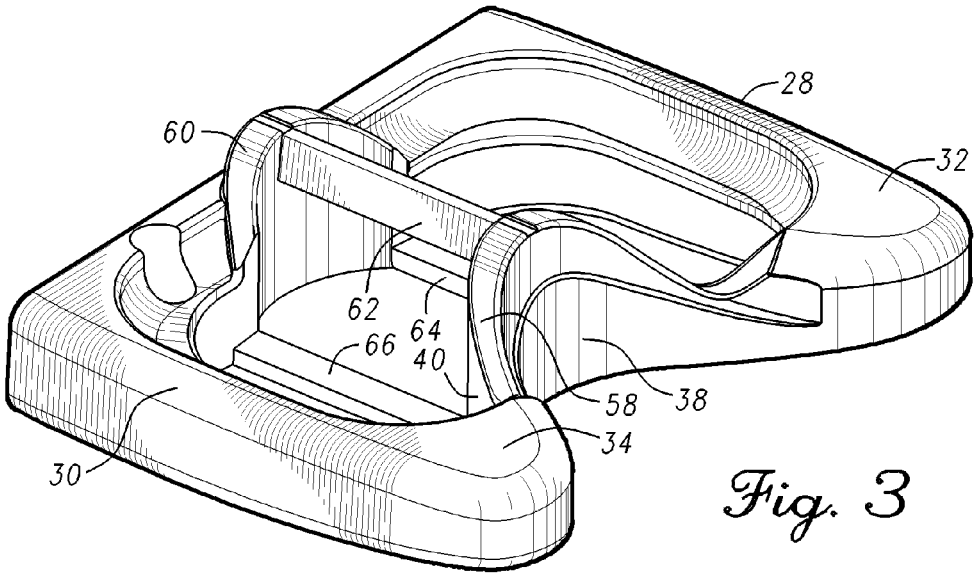
FIG. 3 is a rear perspective view of the putter head of FIG. 1.
Figure 4:
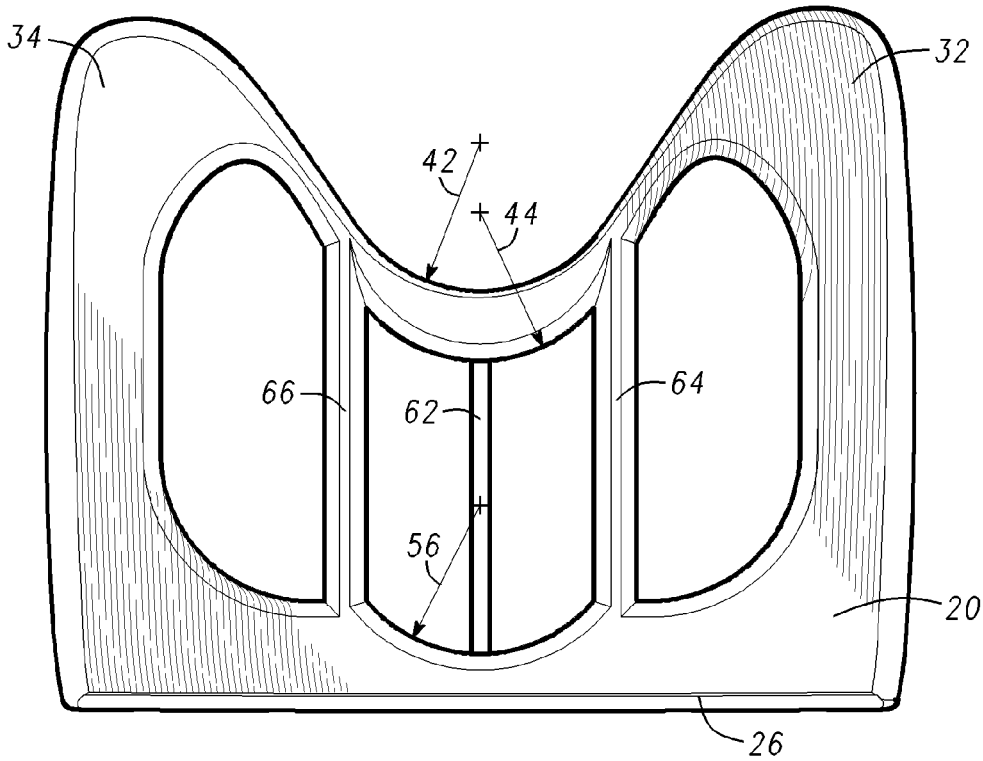
FIG. 4 is a bottom view of the putter head of FIG. 1.

With particular reference to FIG. 2, rear wall member 36 includes a rearwardly facing concave surface 38 and a forwardly convex surface 40. In an illustrative embodiment, rearwardly concave surface 38 has a radius 42 between 0.80 inches and 0.88 inches or approximately the minimum radius of a standard USGA golf ball, but may have a radius of up to 1.25 inch to maintain perspective depending on the overall size of the putter. The forwardly convex surface 40 may also have a radius 44 substantially equal to radius 42. In the illustrative embodiment, front wall member 12 includes a rearward surface 46 that includes a rearwardly concave surface 48 and may include an upwardly extending protrusion in the form of an upright alignment member 50 having a forwardly convex surface 52. The upright alignment member 50 may extend at least 0.25 inch above the top rail 22 and may extend from between 0.25 and 0.75 inch above the top rail 22. Rear wall member 36 may extend upward a complimentary distance so that the upright alignment member 50 of front wall member 12 and the upwardly extending portion of rear wall member 36 provide a three-dimensional alignment aid, which may be approximately the same height as a standard USGA golf ball, thereby further enhancing the ability of an individual to properly line up the putter before putting the a ball.

The radius 54 of rearwardly concave surface 48 and the radius 56 of forwardly convex surface 52 may be equal to radii 42 and 44, respectively such that the rearwardly concave surfaces 38 and 48 are congruent and the forwardly convex surfaces 40 and 52 are also congruent. The arcuate walls 58 and 60 formed by surfaces 38, 40, 48 and 52 having radii substantially equal to a standard golf ball cooperate to form a first alignment aid for assisting an individual to properly line up the putter before putting the golf ball.

Figure 5:
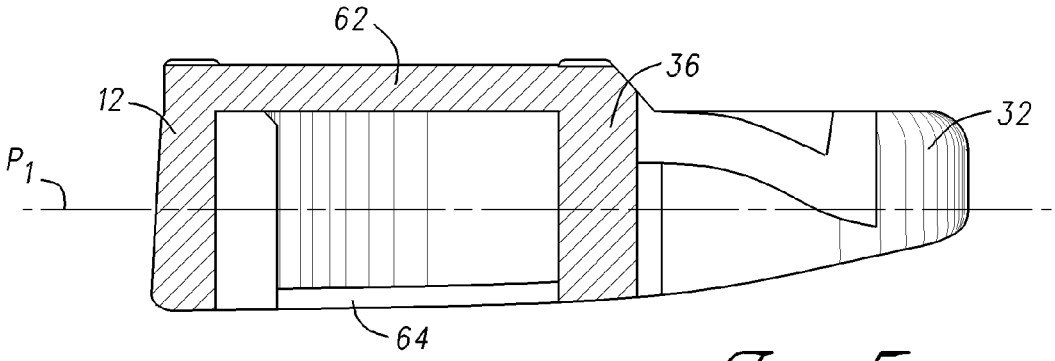
FIG. 5 is a cross-sectional view of the putter head of FIG. 2 taken along line 5-5.
Figure 6:
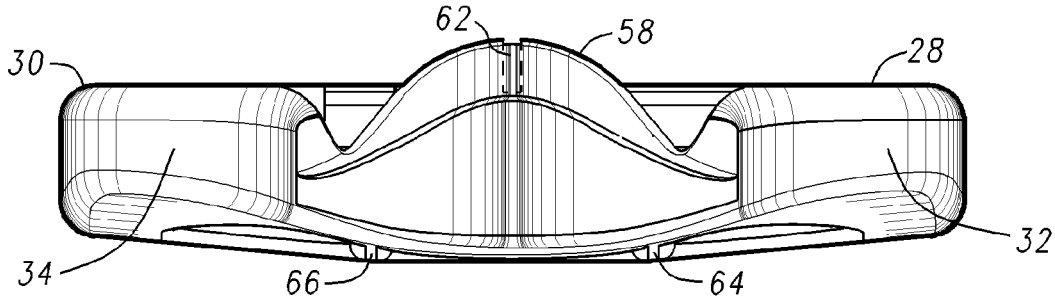
FIG. 6 is a rear view of the putter head of FIG. 1.
Figure 7:
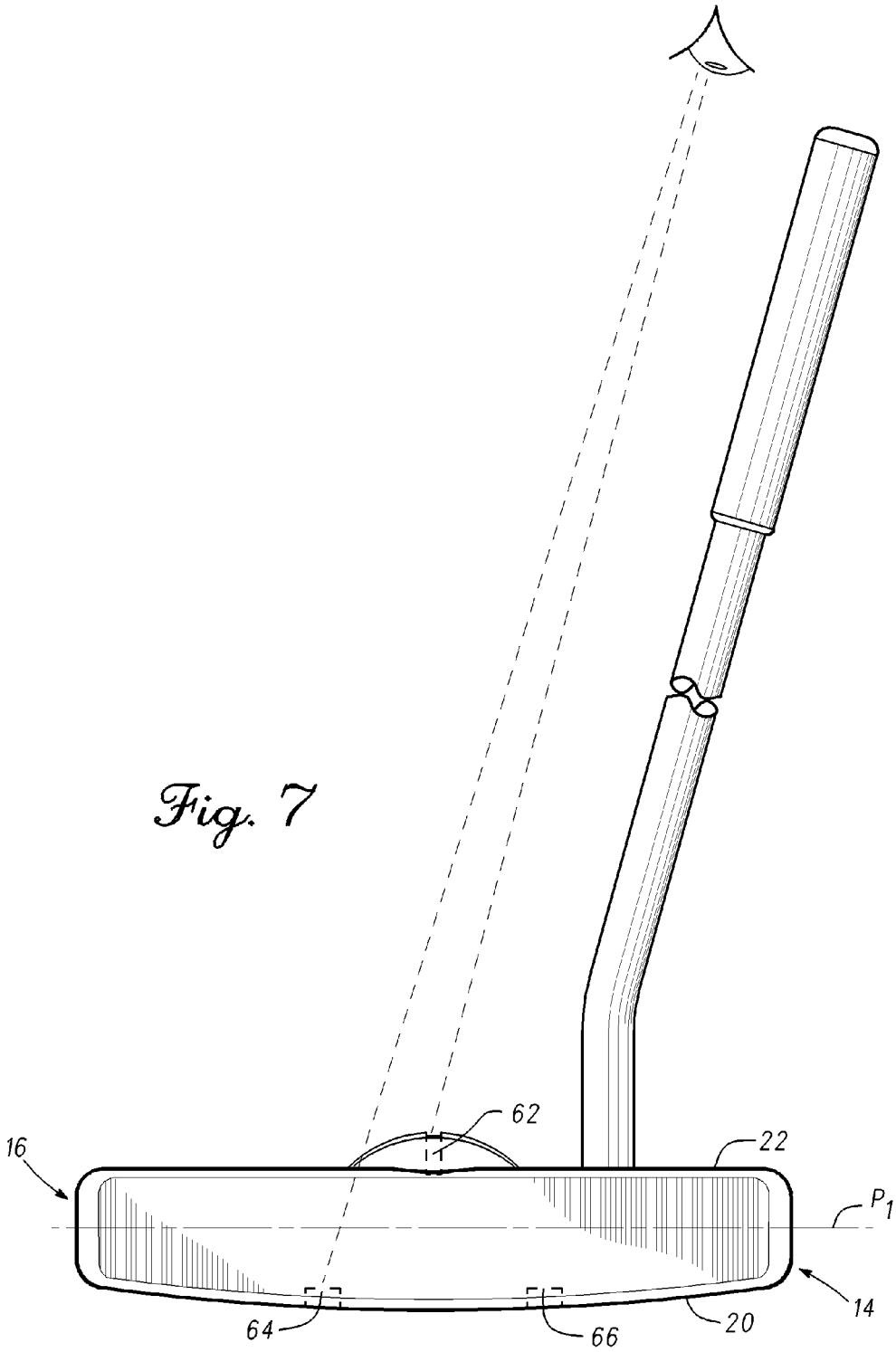
FIG. 7 is a front view of golf club including the putter head of FIG. 1.
Figure 8:
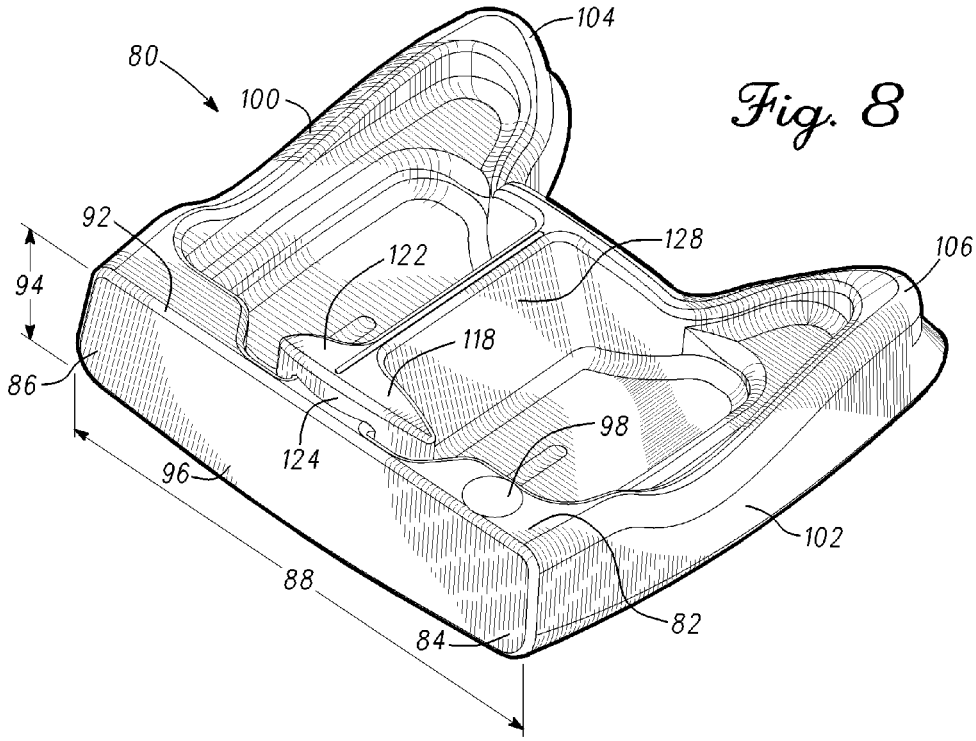
FIG. 8 is a front perspective view of an alternative embodiment of a putter head incorporating features of the present invention.

With particular reference to FIGS. 5 and 7, the opening defined by front wall member 12, first arm 28, second arm 30 and rear wall member 36 is spanned by a central strut 62, a toe end strut 64 and a heel end strut 66. Central strut 62 is offset vertically above an imaginary horizontal plane $p_1$ passing through the middle of front wall member 12 bisecting vertical height dimension 24. Toe end strut 64 and heel end strut 66 are offset horizontally relative to central strut 62 toward the toe end and heel end, respectively. The offset may be symmetrical or asymmetrical to compensate for differences in perspective between the heel and tow of the club when viewed from above. Additionally, first arm 28 and second arm 30 may be of slightly different lengths, also to compensate for differences in perspective such that the club is not perfectly symmetrical about central strut 62. Instead, a line tangent to the face will intersect a line tangent to the rearward portions 32 and 34 at a point behind the user at an angle of less than 10 degrees when the club is held in its normal position prior to addressing the ball.

Toe end strut 64 and heel end strut 66 are offset vertically relative to central strut 64 so that both lie below imaginary horizontal plane $p_1$. Central strut 62 is offset vertically relative toe end strut 64 and toe end strut 64 is offset laterally relative to central strut 62, therefore, central strut 62 and toe end strut 64 are both visible from a point "x" corresponding to the golfer's eye located above club head 10 and offset toward the heel end of club head 10. Central strut 62 and toe end strut 64 thus cooperate to form a transverse alignment aid enabling an individual to address the ball with a consistent lie angle and with correct eye positioning, which can be verified by observing the apparent gap between central strut 62 and toe end strut 64. It should be noted that although central strut 62 and toe end strut 64 are both thin elongate rod-like members, any combination of alignment members offset vertically with edges or other surfaces visible to an individual and for which the relative gap changes with respect to the lie angle of the club are considered within the scope of the invention. For example, combining toe end strut 64 and heel end strut 66 into a solid web extending from toe end strut 64 to heel end strut 66 would still yield an edge to line up with central strut 62 and therefore would provide a three-dimensional alignment aid in accordance with the present invention as discussed below.

With reference to FIGS. 8-12, an alternative embodiment of a golf club head 80 comprises a front wall member 82 having a heel end 84, a toe end 86 and horizontal width dimension 88. Golf club head 80 further comprises a sole 90, a top rail 92 and a vertical height dimension 94 measured between sole 90 and top rail 92. Front wall member 82 further comprises a generally planar front face 96 adapted for impacting a golf ball as well as hosel 98 adapted for receiving a golf club shaft (not shown). Golf club head 80 may be formed of conventional materials such as stainless steel or aluminum and/or may incorporate exotic materials such as aramid or graphite composites or liquid metals all without departing from the scope of the invention Golf club head 80 further includes a first arm 100 that extends generally rearward from toe end 86 of front wall member 82 and a second arm 102 extending generally rearward from heel end 84 of front wall member 82. First arm 100 has rearward portion 104 that is joined to rearward portion 106 of second arm 102 by a rear wall member 108.

Figure 9:
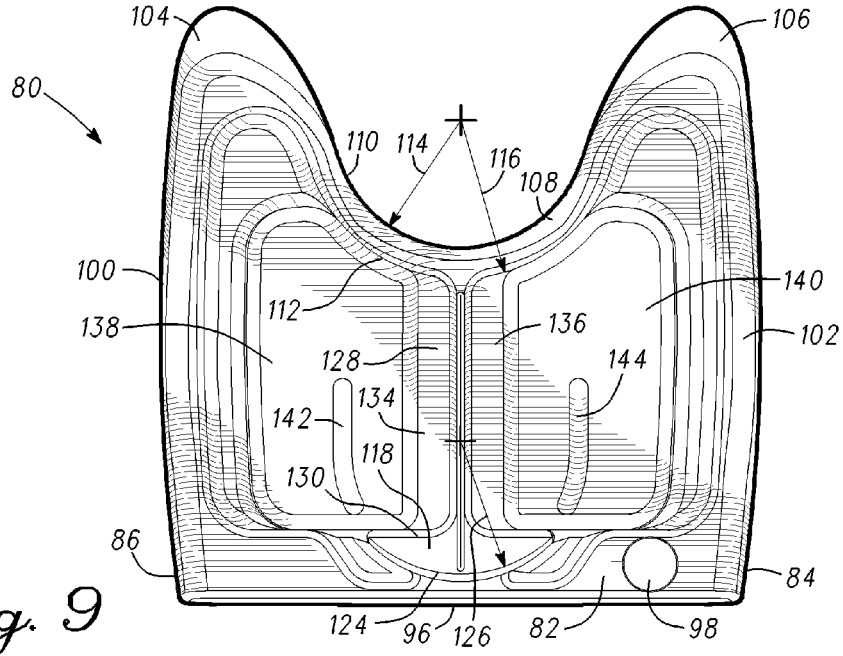
FIG. 9 is a top view of the putter head of FIG. 8.

With particular reference to FIG. 9, rear wall member 108 includes a rearwardly facing concave surface 110 and a forwardly convex surface 112. In the illustrative embodiment, rearwardly concave surface 110 has a radius 114 between 0.80 inches and 0.88 inches, or approximately the minimum radius of a standard USGA golf ball, but may have a radius of up to 1.25 inch to maintain perspective depending on the overall size of the putter. Forwardly convex surface 112 may also have a radius 116 substantially equal to radius 114. With additional reference to FIG. 11, in the illustrative embodiment, front wall member 82 includes a centrally located protrusion 118 that extends a distance 120 of optionally 0.25 to 0.75 inches above top rail 92. Protrusion 118 may have an upper surface 122, which may be flat or optionally an upwardly convex upper surface, which also may have a radius 123 of between 0.80 inches and 0.88 inches, or approximately the minimum radius of a standard USGA golf ball, but may have a radius of up to 1.25 inch to maintain perspective depending on the overall size of the putter. Centrally located protrusion 118 further includes a forwardly convex surface 124 having a radius 126 that may be between 0.80 inches and 0.88 inches, but may have a radius of up to 1.25 inch to maintain perspective depending on the overall size of the putter.

Figure 11:
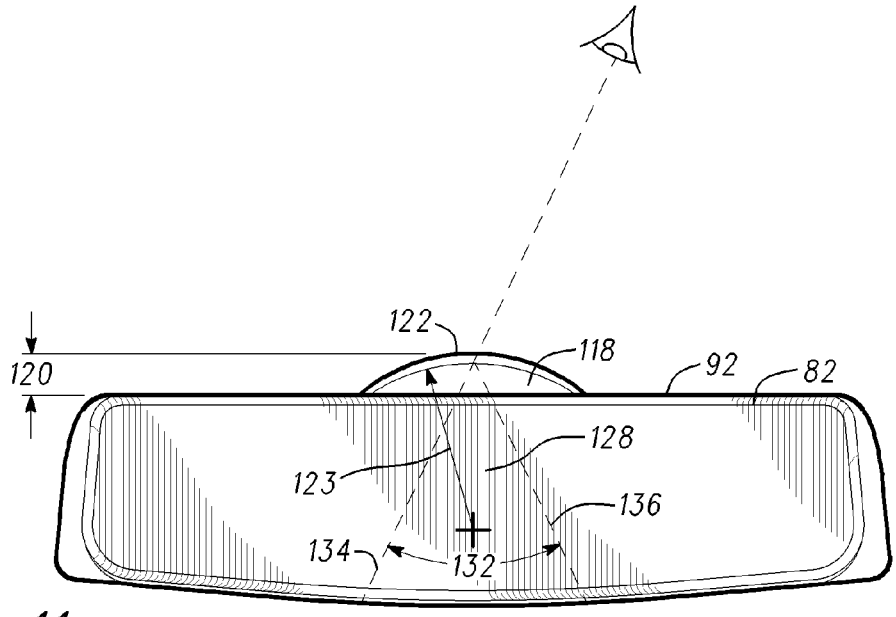
FIG. 11 is a front view of the putter head of FIG. 8.

A central web member 128 extends from the rear surface 130 of protrusion 118 to forwardly convex surface 112 of rear wall member 108. With particular reference to FIG. 11, web member 128 is a triangular parallelepiped, that is, it has substantially straight sides with either a true triangular cross-section or a trapezoidal cross section comprising a substantially triangular cross section with a small flat at the top. The cross section may be an isosceles triangular cross-section having an apex angle 132 of between 5 degrees and 60 degrees. Apex angle 132 is such that sides 134 and 136 of web member 128 cooperate to form a transverse alignment aid to enable an individual to address the ball with a consistent line angle and with correct eye positioning similar to the function of struts 62-66 of the embodiment of FIG. 1. Contrasting paint and/or other markings may be added to sides 134 and 136 to enhance contrast.

The region between first arm 100 and web member 128 is closed off by a relatively thin closure member 138. Similarly the region between second arm 102 and web member 128 is closed off by a closure member 140. Reliefs 142 and 144 are formed in closure members 138 and 140 and as shown in FIG. 9 and blend with forwardly convex surface 124 of centrally located protrusion 118 to create a U-shaped alignment aid when viewed from above. This complements the forwardly convex surface 112 of rear wall member 108 to form a three dimensional alignment aid.

Figure 10:
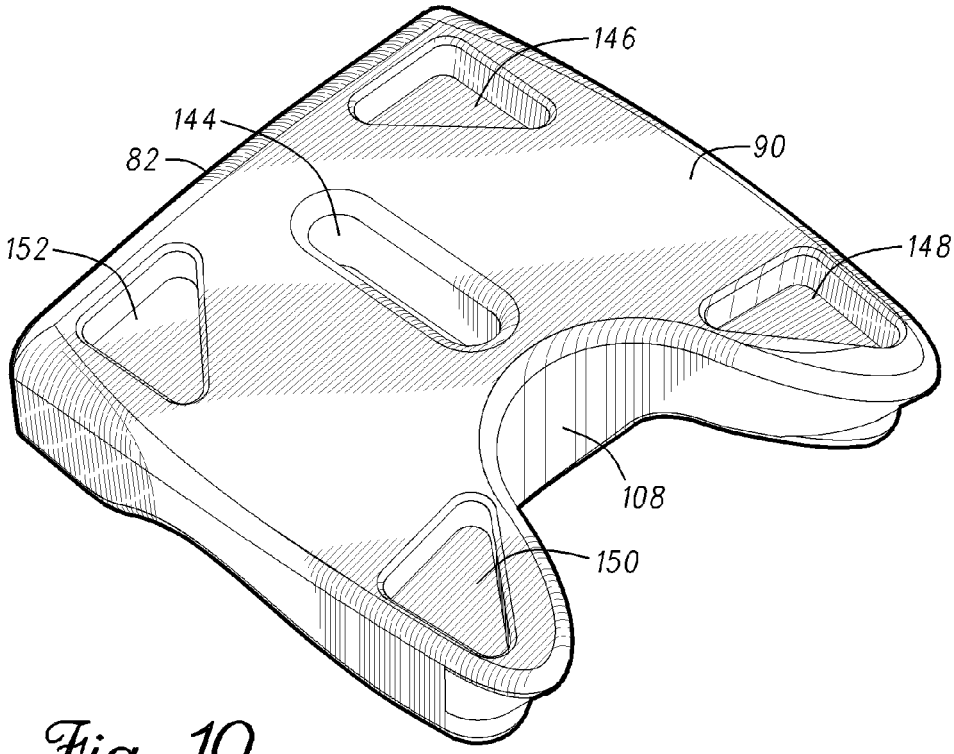
FIG. 10 is a bottom perspective view the putter head of FIG. 8.
Figure 12:
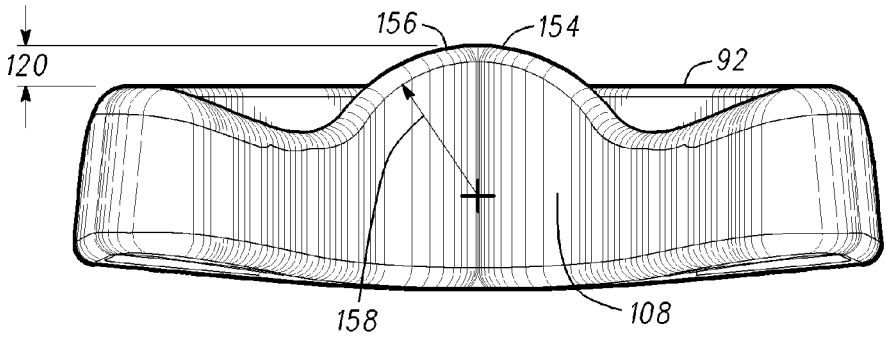
FIG. 12 is a rear view of the putter head of FIG. 8.

With reference to FIG. 10, sole 90 may include pockets 144, 146, 148, 150 and 152, which may be left empty or filled with lightweight and/or dense materials to adjust the polar moment of inertia of golf club head 80 and lower its center of gravity. With reference to FIG. 12, rear wall member 108 includes an upright flange portion 154. In the illustrative embodiment, upright flange portion 154 has an upwardly facing convex upper surface 156 that may have a radius 158 of between 0.80 and 0.88 inches, but may have a radius up to 1.25 inch to maintain perspective depending on the overall size of the putter and may extend the same distance 120 above top rail 92 as centrally located protrusion 118. This enables upright flange 154 and centrally located protrusion 118 to provide a three-dimensional alignment aid, which may be approximately the same height as a standard USGA golf ball.

With further referenced to FIGS. 13-17, another alternative embodiment of a golf club head 160 comprises a front wall member 162 having a heel end 164, a toe end 166 and a horizontal width dimension 168. Golf club head 160 further comprises a sole 170, a top rail 172 and a vertical height dimension 174 measured between sole 170 and top rail 172. Front wall member 162 further comprises a generally planar front face 176 adapted for impacting a golf ball. Golf club head 160 may be formed of conventional materials such as stainless steel or aluminum and/or may incorporate exotic materials such as aramid or graphite composites or liquid metals all without departing from the scope of the invention Golf club head 160 further includes a first arm 180 that extends generally rearward from toe end 166 of front wall member 162 and second arm 182 that extends generally rearward from heel end 164 of front wall member 162. First arm 180 has a rearward portion 184 that is joined to rearward portion 186 of second arm 182 by a rear wall member 188.

Figure 13:
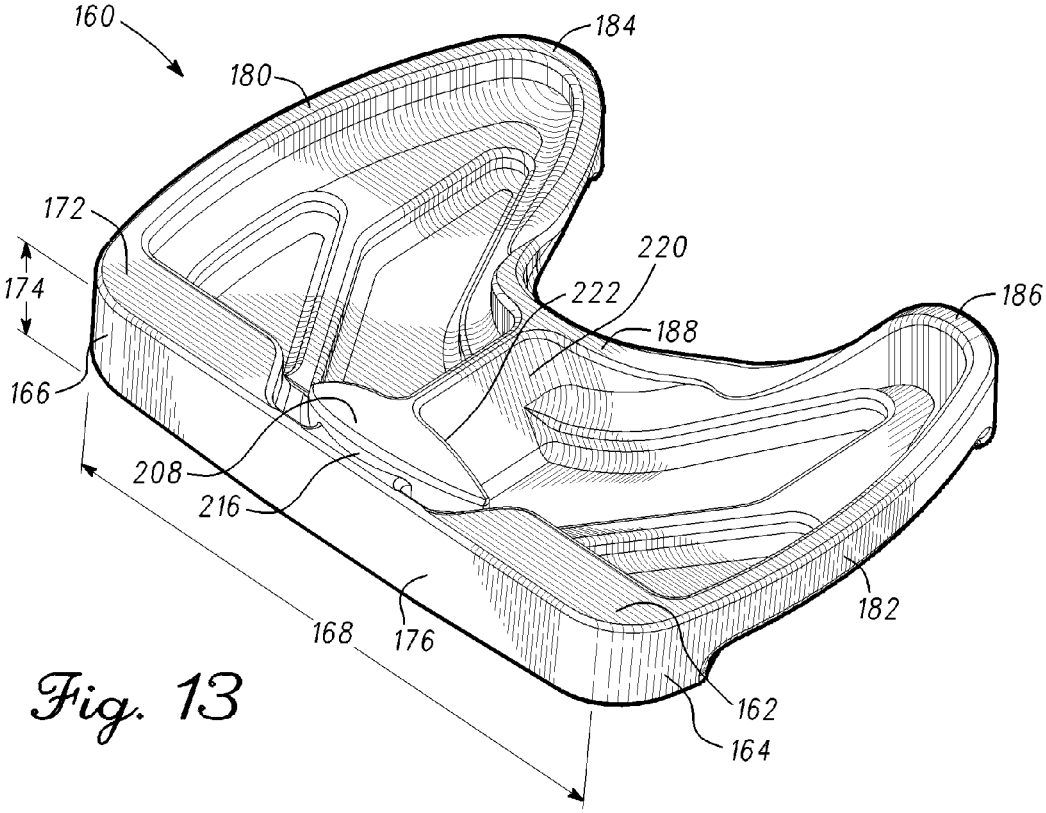
FIG. 13 is a front perspective view of another alternative embodiment of a putter head incorporating features of the present invention.
Figure 15:
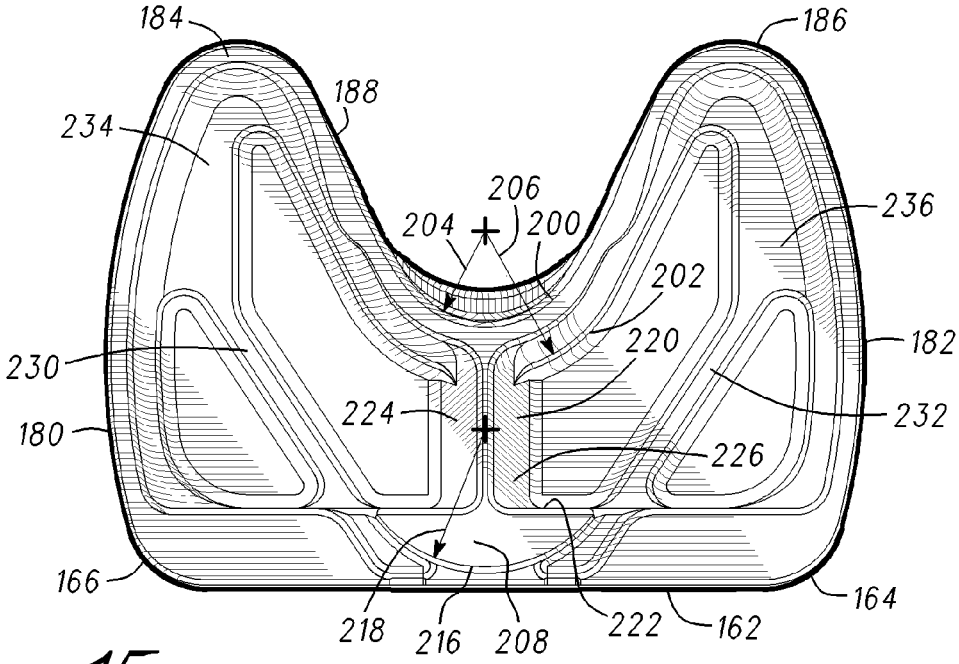
FIG. 15 is a top view of the putter head of FIG. 13.

With particular reference to FIGS. 13 and 15, rear wall member 188 includes a rearwardly facing concave surface 200 and a forwardly convex surface 202. In the illustrative embodiment rearwardly concave surface 200 has a radius 204 between 0.80 inches and 0.88 inches, or approximately the minimum radius of a standard USGA golf ball, but may have a radius of up to 1.25 inch to maintain perspective depending on the overall size of the putter. Forwardly convex surface 202 may also have a radius 206 substantially equal to radius 204. With additional reference to FIG. 16, front wall member 162 includes a centrally located protrusion 208 that extends a distance 210 of optionally 0.25 to 0.75 inches above top rail 172. Protrusion 208 may have a surface 212, which may be flat or optionally an upwardly convex upper surface, which also may have a radius 214 of between 0.80 inches and 0.88 inches, but may have a radius of up to 1.25 inch to maintain perspective depending on the overall size of the putter. Centrally located protrusion 208 further includes a forwardly convex surface 216 having a radius 218 that may be between 0.80 inches and 0.88 inches, but may have a radius of up to 1.25 inch to maintain perspective depending on the overall size of the putter.

Figure 16:
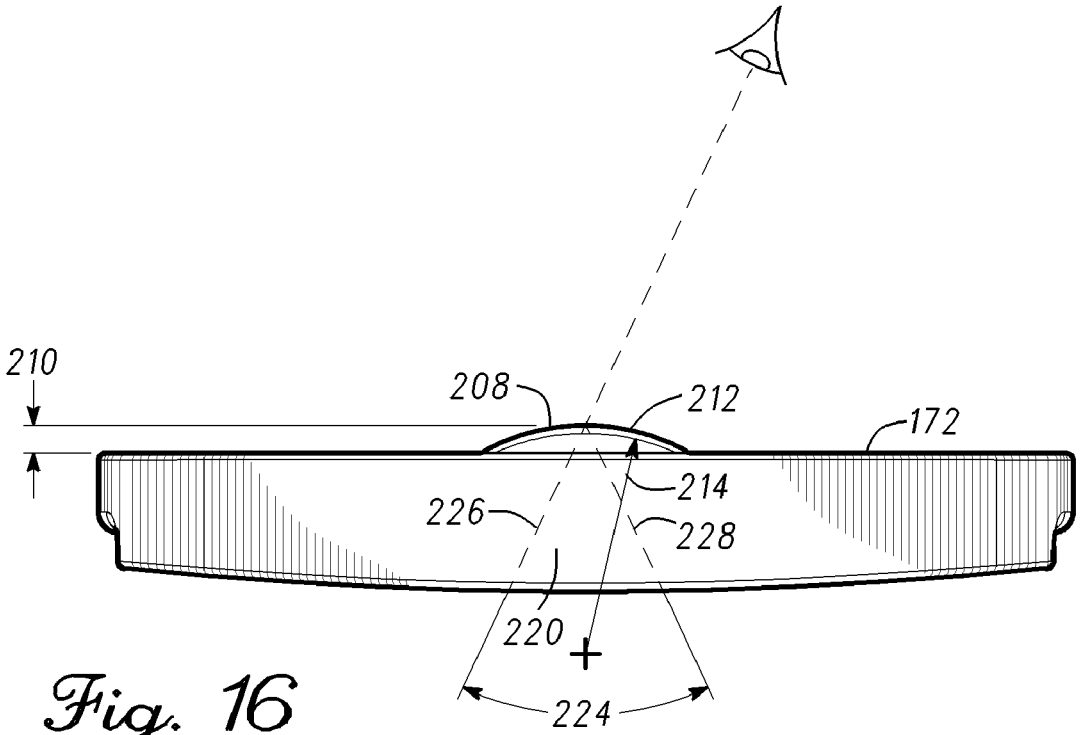
FIG. 16 is a front view of the putter head of FIG. 13.

A central web member 220 extends from the rear surface 222 of centrally located protrusion 208 to forwardly convex surface 202 of rear wall member 188. As shown in FIG. 16, central web member 220 is a triangular parallelepiped, that is, it has substantially straight sides with either a true triangular cross-section or a trapezoidal cross section comprising a substantially triangular cross section with a small flat at the top. The cross-section that may be a substantially isosceles triangular cross-section having an apex angle 224 of between 5 degrees and 60 degrees. Apex angle 224 is such that sides 226 and 228 of central web member 220 cooperate to form a transverse alignment aid to enable an individual to address the ball with a consistent lye angle and with correct eye positioning. As with the embodiment of FIGS. 8-12, contrasting paint and/or other markings may be added to sides 226 and 228 to enhance contrast.

Figure 14:
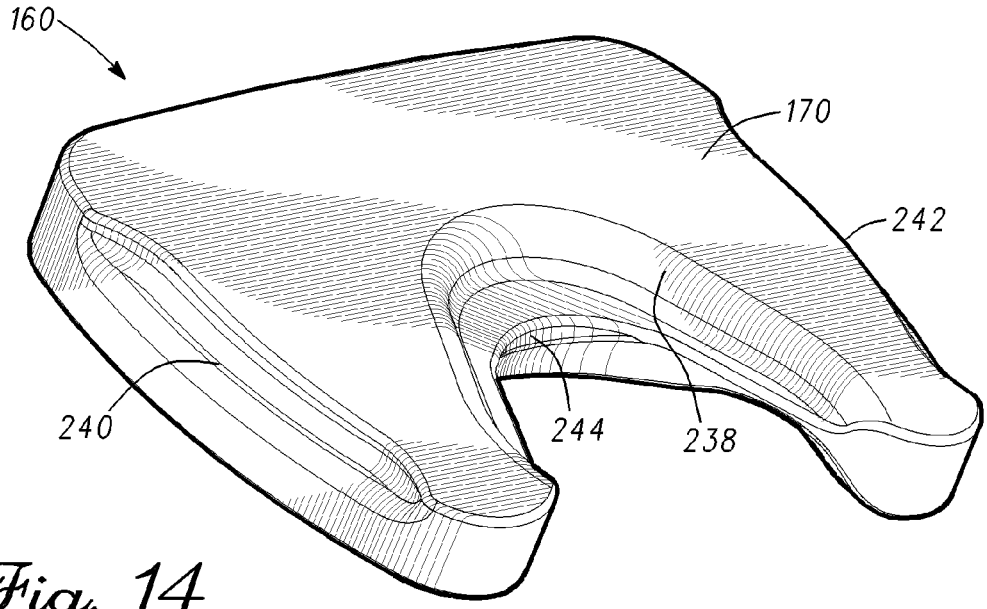
FIG. 14 is a bottom perspective view of the putter head of FIG. 13.

With particular reference to FIGS. 14 and 15, golf club head 160 has a substantially solid bottom surface that is thin relative to vertical height dimension 174 of front wall member 162. Golf club 160 includes a first rib 230 that extends from thickened region 234 of first arm 180, and a second rib 232 that extends from thickened region 236 of second arm 182. Ribs 230 and 232 are oriented to blend with convex surface 216 to create a V-shaped alignment aid when viewed from above, which complements the forwardly convex surface 202 of rear wall member 188 to form a three-dimensional alignment aid.

Figure 17:
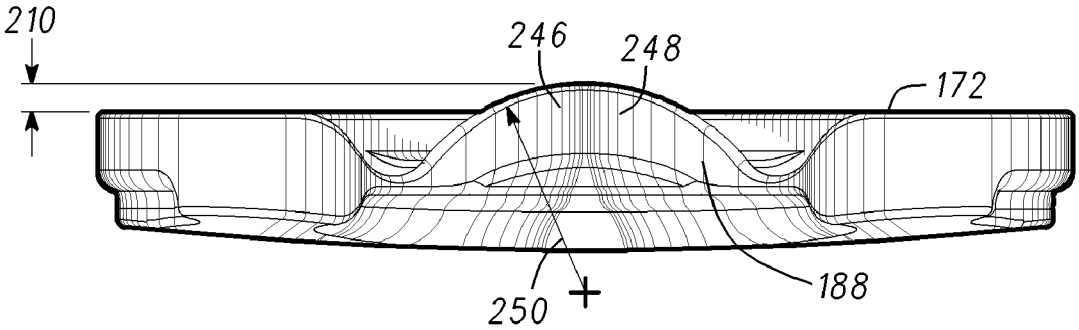
FIG. 17 is a rear view of the putter head of FIG. 13.

As shown in FIG. 14, sole 170 may include beveled regions 238, 240 and 242 and may include a lip 244 to allow the putter to act as a ball scoop. With further reference to FIG. 17, rear wall member 188 includes an upright flange portion 246 which may have an upwardly facing convex upper surface 248 that may have a radius 250 of between 0.80 and 0.88 inches, but may have a radius of up to 1.25 inch to maintain perspective depending on the overall size of the putter and may extend the same distance 210 above top rail 172 as centrally located protrusion 208. This enables upright flange 246 and centrally located protrusion 208 to provide a three-dimensional alignment aid, which may be approximately the same height as a standard USGA golf ball.

Although certain illustrative embodiments and methods have been disclosed herein, it will be apparent from the foregoing disclosure to those skilled in the art that variations and modifications of such embodiments and methods may be made without departing from the scope of the invention. Accordingly, it is intended that the invention should be limited only to the extent required by the appended claims and the rules and principles of applicable law.

What is claimed is:

1. A golf club head comprising:

a front wall member having a heel end and a toe end defining a horizontal width dimension, a sole and a top rail defining a vertical height dimension, a rear surface and a substantially planar front surface arranged for impacting a golf ball;

a first arm extending generally rearward from the toe end of said front wall member, said first arm having a forward portion and a rear portion;

a second arm extending generally rearward from the heel end of said front wall member, said second arm having a forward portion and a rear portion, said first arm being longer than said second arm such that a line drawn tangent to the rear portions of said first and second arms intersects a line drawn tangent to the front wall member at an angle of less than 10 degrees; and a rear wall member joining the rear portions of the first and second arms, said rear wall member comprising an upright flange having forward and a rear surface and a vertical height greater than its thickness, the rear surface of said rear wall member comprising a central rearwardly concave rear portion and the forward surface of said rear wall member comprising a central forwardly convex forward portion.

2. The golf club head of claim 1, wherein:

said upright flange has an upwardly convex upper surface.

3. The golf club head of claim 2, wherein:

said front wall member, said first arm, said second arm and said rear wall member collectively define an opening that extends through the golf club head.

4. The golf club head of claim 2, wherein:

the rear surface of said front wall member further comprises a central rearwardly concave rear portion that cooperates with the rearwardly concave rear portion of the rear wall member to form an alignment aid oriented along a central front-to-rear axis of said golf club head.

5. The golf club head of claim 4, wherein:

the rearwardly concave rear portion of said front wall member and the rearwardly concave rear portion of said rear wall member each have a radius of between 0.80 and 1.25 inches.

6. The golf club head of claim 2, further comprising:

an upper rod member oriented perpendicular to the planar front surface of said golf club head and extending between the forwardly convex portion of said rear wall member and the rearwardly concave portion of said front wall member.

7. The golf club head of claim 6, further comprising:

a first lower rod member, said first lower rod member extending between the rear surface of said front wall member and the forward surface of said rear wall, said first lower rod member being oriented parallel to, and displaced laterally and vertically downward from said upper rod member to form a transverse alignment aid.

8. The golf club head of claim 2, further comprising:

first and second lower rod members each extending between the rear surface of said front wall member and the forward surface of said rear wall member.

9. The golf club head of claim 8, wherein:

said first and second lower rod members are parallel.

10. The golf club head of claim 2, wherein:

said front wall member includes a centrally located protrusion that extends above the top rail of said front wall member.

11. The golf club head of claim 2, wherein:

the rear portions of said first and second arms each comprises a rearwardly convex protuberance extending rearwardly beyond the rear wall member.

12. A golf club head comprising:

a front wall member having a heel end and a toe end defining a horizontal width dimension, a sole and a top rail defining a vertical height dimension, a rear surface and a substantially planar front surface arranged for impacting a golf ball, the front wall member including a centrally located protrusion having an upwardly convex upper surface that extends above the top rail of the front wall member;

a first arm extending generally rearward from the toe end of the front wall member, the first arm having a forward portion and a rear portion;

a second arm extending generally rearward from the heel end of the front wall member, the second arm having a forward portion and a rear portion; and a rear wall member joining the rear portions of the first and second arms, the rear wall member comprising an upright flange having forward and a rear surface and a vertical height greater than its thickness, the rear surface of the rear wall member comprising a central rearwardly concave rear portion and the forward surface of said rear wall member comprising a central forwardly convex forward portion, the upright flange also having an upwardly convex upper surface.

13. The golf club head of claim 12, wherein:

the centrally located protrusion extends no more than 0.75 inches above the top rail of said front wall member.

14. The golf club head of claim 13, wherein:

the centrally located protrusion extends about 0.25 inches above the top rail of said front wall member.

15. The golf club head of claim 12, wherein:

the centrally located protrusion has a forwardly convex front surface that cooperates with the rearwardly concave rear portion of the rear wall member to form an alignment aid oriented along a central front-to-rear axis of said golf club head.

16. The golf club head of claim 15, wherein:

the forwardly convex front surface of the centrally located protrusion has a radius substantially equal to the radius of the rearwardly concave rear portion of the rear wall member.

17. The golf club head of claim 16, wherein:

the upright flange of the rear wall member extends to substantially the same height as the centrally located protrusion.

18. A method of forming a golf club head comprising:

forming a front wall member having a heel end and a toe end defining a horizontal width dimension, a sole and a top rail defining a vertical height dimension, a rear surface and a substantially planar front surface arranged for impacting a golf ball;

forming a first arm extending generally rearward from the toe end of said front wall member, said first arm having a forward portion and a rear portion;

forming a second arm extending generally rearward from the heel end of said front wall member, said second arm having a forward portion and a rear portion, said first arm being longer than said second arm such that a line drawn tangent to the rear portions of said first and second arms intersects a line drawn tangent to the front wall member at an angle of less than 10 degrees; and forming a rear wall member joining the rear portions of the first and second arms, said rear wall member comprising an upright flange having forward and a rear surface and a vertical height greater than its thickness, the rear surface of said rear wall member comprising a central rearwardly concave rear portion and the forward surface of said rear wall member comprising a central forwardly convex forward portion.

19. The method of claim 18, further comprising:

forming the upright flange to have an upwardly convex upper surface.

20. The method of claim 18, further comprising:

forming a protrusion that extends above the center of the top rail of the front wall member.

21. The method of claim 20, wherein:

the protrusion extends about 0.25 inch above the top rail of the front wall member.

22. The method of claim 20, wherein:

the protrusion has a forwardly convex front surface that cooperates with the rearwardly concave rear portion of the rear wall member to form an alignment aid oriented along a central front-to-rear axis of said golf club head.

23. The method of claim 18, wherein:

the protrusion extends no more than 0.75 inch above the top rail of the front wall member.

24. The method of claim 18, further comprising:

forming a transverse alignment aid extending from the front wall member to the rear wall member along a front-to-rear axis of said club head.

25. The method of claim 24, wherein:

the transverse alignment aid comprises an upper rod member and a lower rod member, the lower rod member being oriented parallel to and displaced laterally and vertically downward from the upper rod member.

* * * * *